US006785113B1

(12) United States Patent
Pham

(10) Patent No.: US 6,785,113 B1
(45) Date of Patent: Aug. 31, 2004

(54) OZONE REMOVABLE ELECTRODE CORONA GENERATION SYSTEM

(76) Inventor: Robert Truong Pham, 303 N. Clear Creek Dr., Friendswood, TX (US) 77546

( * ) Notice: Subject to any disclaimer, the term of this patent is extended or adjusted under 35 U.S.C. 154(b) by 298 days.

(21) Appl. No.: 10/002,875

(22) Filed: Dec. 5, 2001

Related U.S. Application Data

(60) Provisional application No. 60/300,676, filed on Jun. 25, 2001.

(51) Int. Cl.[7] ..... H01T 19/04

(52) U.S. Cl. ..... 361/230; 361/229; 361/220; 361/225; 361/231; 361/232; 165/46; 165/109.1; 165/96; 165/95; 165/50; 138/162

(58) Field of Search ..... 361/230, 229, 361/220, 225, 231, 232; 165/46, 109.1, 96, 95, 50; 138/162

(56) References Cited

U.S. PATENT DOCUMENTS 3,789,278 A * 1/1974 Bingham et al. ..... 361/229
4,724,508 A * 2/1988 Macy ..... 361/225
5,560,397 A * 10/1996 Miller et al. ..... 138/110

* cited by examiner

*Primary Examiner*—Dean A. Reichard
*Assistant Examiner*—Anton Harris
(74) *Attorney, Agent, or Firm*—Joseph T. Regard, Ltd

(57) ABSTRACT

A manually switchable corona electrode array and method of operation for use in a corona treater station. The preferred embodiment of the present invention contemplates an electrode array which incorporates in its structure a low pressure conduit system for providing a low pressure field in the vicinity of the corona field, in order to remove ozone and other contaminants generated by the corona field. The electrode array further includes means to quickly and easily urge the array from a first position, wherein the array is situated adjacent to the treatment area, to a second position, removed from the treatment area, so as to facilitate maintenance and spooling of the material to the treated therethrough. The present invention provides a more compact footprint than traditional systems, as well as providing an ozone removal system requiring a cheaper, less powerful exhaust blower for providing the low pressure differential to remove the pollutants, including ozone, from the treatment area. Lastly, the design of the present invention provides a unique cooling system, utilizing the circulation of air through the electrodes in removing the pollutants in order to cool the electrodes, so as to prevent thermal overload.

11 Claims, 9 Drawing Sheets

OZONE REMOVABLE ELECTRODE CORONA GENERATION SYSTEM

This application claims the benefit of Provisional Application No. 60/300,676 filed Jun. 25, 2001.

FIELD OF THE INVENTION

The present invention relates to corona generators for use in treater stations in treating a linearly progressing, flattened tube or sheet of polymer film or the like, and in particular to a removeable corona electrode array and method of operation for use in a corona treater station.

The preferred embodiment of the present invention contemplates an electrode array which incorporates in its structure a low pressure conduit system for providing a low pressure field in the vicinity of the corona field, in order to remove ozone and other contaminants generated by the corona field. The electrode array further includes means to quickly and easily urge the array from a first position, wherein the array is situated adjacent to the treatment area, to a second position, removed from the treatment area, so as to facilitate maintenance and spooling of the material to the treated therethrough.

The present invention provides a more compact footprint than traditional systems, as well as providing an ozone removal system requiring a cheaper, less powerful exhaust blower for providing the low pressure differential to remove the pollutants, including ozone, from the treatment area. Lastly, the design of the present invention provides a unique cooling system, utilizing the circulation of air through the electrodes in removing the pollutants in order to cool the electrodes, so as to prevent thermal overload.

GENERAL SUMMARY DISCUSSION OF THE INVENTION

The current state of the art corona electrode system consists of multiple segments that are stacked together tightly like stacking a row of very small books on a shelf. An intricate mechanical structure is used to support the segments and provide the necessary mechanism for adjusting them. The segments are supported on the tangential line of a treat roller. The air space between the face of the segments and the face of the roller is where corona is generated and can be adjusted by mechanical means during use.

However, the most important feature of the modern system is that each individual segment can be adjusted to move towards or away from the roller face to treat or not treat, respectively. The ability to select to treat or not treat with each individual segment allows treating in single or multiple lanes across the web. The effective end-to-end treat width of a modem electrode system ranges from a few inches to a few feet depending on the size of the web.

The Ozone Removable Corona Electrode System consists of a specifically designed segment and a matching mechanical structure in which an air passage is formed for the purpose of removing ozone, a corona byproduct. The novelty in this system is that as each segment is adjusted to treat or not treat, the exhaust passage for the ozone simultaneously is connected or disconnected. The basic principle to design and fabricate such a system can be applied to make a pivotal segment design or a push-pull segment design. Moreover, the segment can be bare metal for use with a dielectric-covered roll, or dielectric-covered metal for use with a bare roll. dr

BRIEF DESCRIPTION OF DRAWINGS

For a further understanding of the nature and objects of the present invention, reference should be had to the following detailed description, taken in conjunction with the accompanying drawings, in which like parts are given like reference numerals, and wherein.

DETAILED DISCUSSION OF THE INVENTION

Figure 1:
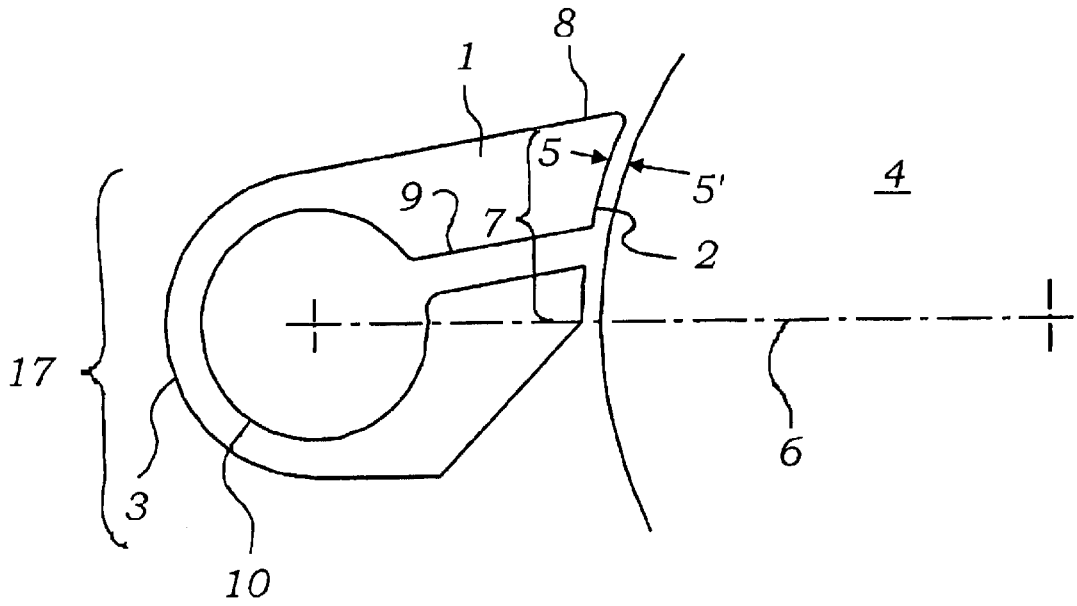
FIG. 1 is an end view of the preferred embodiment of the electrode array in relation to a treatment roller.

FIG. 1 shows a design of the pivotal electrode 1 segment, which can be made out of ⅛" thick metal sheet. The concave end 2 of the segment is designed to be tangent to the treater roll 4, which it faces so that an equal air gap 5, 5' is maintained to provide a consistent treatment area 7 for an even corona distribution; accordingly, the electrode 1 segment and treater roller 4 are axially aligned 6. A large radial cutout is made in the aft portion 3 of the segment. A rectilinear cutout portion 8 is made to intersect with the circular cutout and break out through the concave end of the segment. Both cutouts form a two-dimensional air chamber similar to the cross section of a bellow, comprising an exhaust passage 9 and a vent tube passage 10.

Figure 2A:
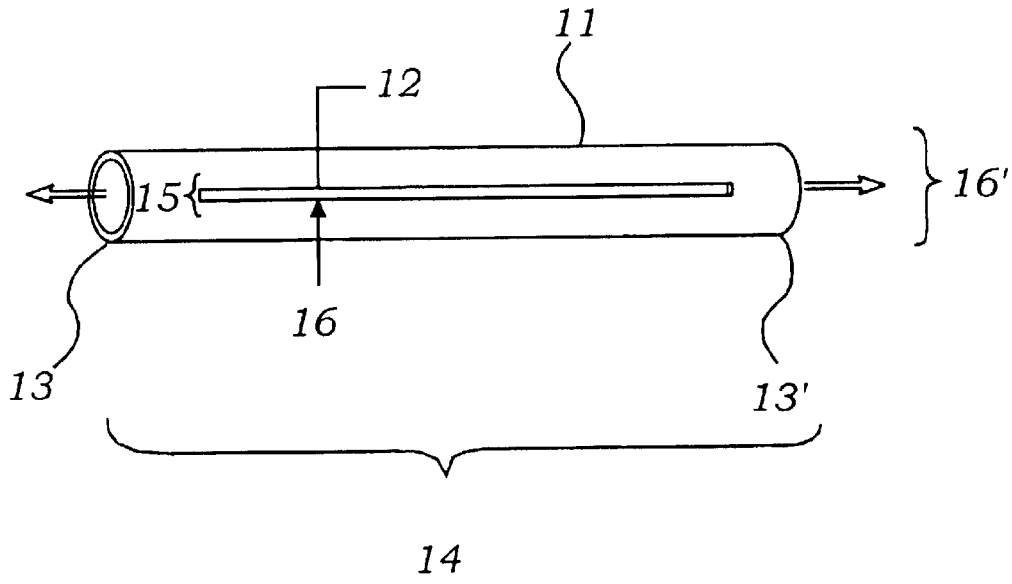
FIGS. 2A and 2B illustrate frontal views of an exhaust tube configured to interface with the electrode array of FIG. 1.
Figure 2B:
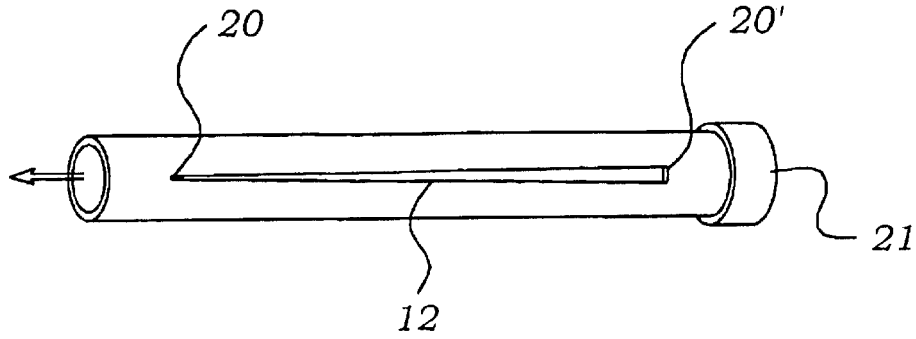

FIGS. 2A and 2B show a vent tube 11 having first 13 and second 13' ends, and a length 14, the tube having an exhaust channel 12 having a length 16 and a width 15 formed in the sidewall of the tube aligned with its longitudinal axis. The vent tube 11 is configured to slidingly engage the vent tube passage 10 formed in the electrode segment 1 in the system of FIG. 1, for the purpose of ozone removal by connecting it to an exhaust blower.

The tube design shown in FIG. 2A is to accommodate an exhaust system that can be connected to both ends of the tube. As shown, the exhaust channel 12 comprises a slot milled through the wall of the tube extending mostly the entire length of the tube. For ease of fabrication, the width of the slot can be made constant and no larger than the width of the rectangular cutout in the segment.

FIG. 2B shows a tube design to accommodate an exhaust system that connects only to one end of the tube, with a cap at the opposing end. For this configuration, the slot forming the exhaust channel 12 is milled through the wall of the tube in a gradually tapered 20, 20' configuration. To equalize the air pressure, the exhaust is connected to the end of the tube closest to the narrow end of the tapered slot. In either design, standard engineering calculations can be carried out to determine the size of the slot to optimize the design of the exhaust system.

Figure 3:
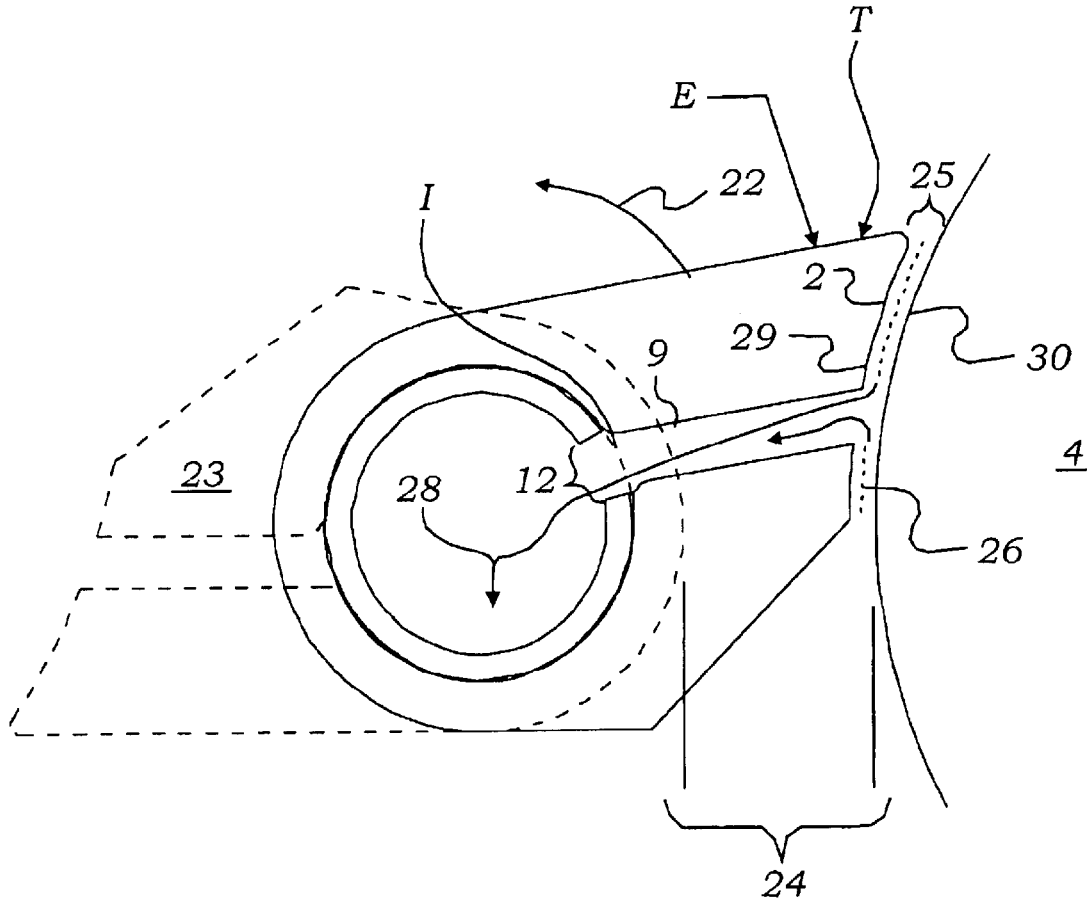
FIG. 3 is an end view of the system of FIG. 1, incorporating the exhaust tube of FIGS. 2A and 2B, further illustrating in phantom the pivotal disassociation of the electrode array away from the treatment roller.

FIG. 3 shows the cross sectional view of a simplified assembly of the electrode array comprising a plurality of electrode segments stacked in face to face engagement. The slot forming the exhaust channel 12 for the vent tube is positioned so as to be aligned with the exhaust passage 9 formed in the rectangular cutout portion of the electrode segments while in the 'treat position' T, that is, with the concave end 2 adjacent to the treater roller 4. In the 'treat position', the concave end of the segment spaces out ⅛" or less from the face of the treat roller. This ⅛" space is the air gap forming the treatment area 25 in which corona 26 is generated. The air gap is consistently formed as the concave end has a radial surface 29 which is configured to engage the radial surface 12 of the treater roller 4 to form an evenly spaced treatment surface therebetween, when the electrode is in the treat position.

Thus in the treat position T, the segment 'makes' corona since the narrow air gap allows ionization to take place and electric current can flow. It is analogous to 'making' electrical contact by closing a switch allowing electricity to flow. When the segment is pivoted (22) 180° out 23 of the treat position, the air gap 24 increases to ¾" or more and effectively 'breaks' the electrical contact and stops the generation of corona.

The novelty in the Ozone Removable Corona Electrode System is that when each segment is selected to treat or not treat, the ozone exhaust connection at the interface of the exhaust channel 12 and the exhaust passage 9 and the corona generation are 'made' or 'broken' at their interface I simultaneously. This allows the highest concentration of ozone, estimated at 200 ppm in air for every 1 kW of corona generated, to selectively be removed segment by segment.

Figure 4:
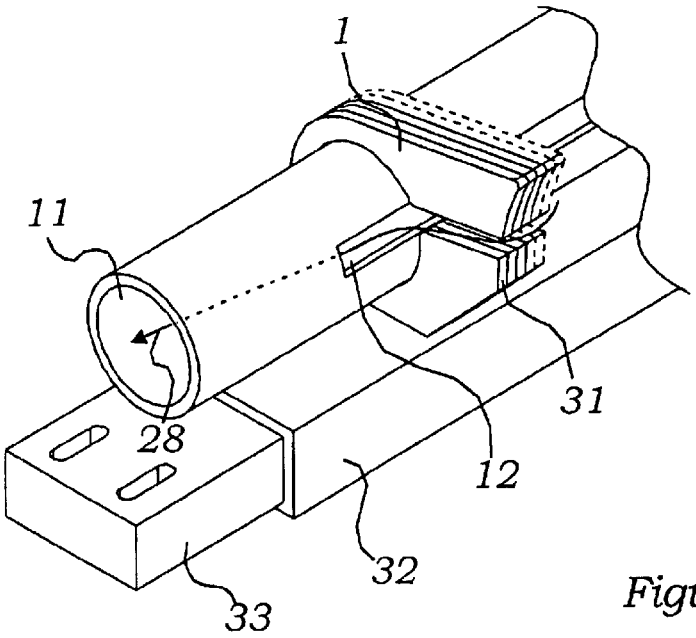
FIG. 4 is an isometric view of the invention of FIG. 3, illustrating multiple, electrodes situated adjacent to one another to form the electrode array of FIG. 1, the system further shown on a base having a mount.

FIG. 4 shows the rest of the components that are necessary to construct a fully functional Ozone Removable Corona Electrode System. As shown, a plurality of electrode segments 1 stacked in aligned, face to face engagement forms the electrode component 31 of the system, which is pivotally mounted to the vent tube 11 so as to facilitate exhaust 28 through the tube when the element component is in the treat position adjacent to the treat roller. The vent tube is supported at its ends (which protrude from each end of the element component) via a support channel 32 made of stainless steel or aluminum, which is used as the weight bearing structure that the ozone exhaust tube and all the segments are mounted to.

At the ends of the support channel, a bar 33 made of an insulator material with good mechanical properties is inserted and rigidly fastened to the channel. The entire electrode assembly is mounted inside a treater station using the insulator bars. The ozone exhaust connection is made at the end(s) of the vent tube using hose or pipe made of a suitable insulator material such as PVC or Teflon.

In summary, the method of the preferred embodiment of the present invention may comprise the following steps, for example:

2. The method of providing a corona field in the vicinity of an outer surface of a treater roll having an outer surface, comprising the steps of:
   a. providing a corona electrode system, comprising:
      a vent conduit having first and second ends, an outer wall, a longitudinal axis, and a slot formed through said outer wall;
      an electrode member comprising an electrode member body having an opening formed therethrough to receive said outer wall of said vent conduit, said electrode member further comprising an electrode surface for corona field generation, said electrode surface having formed therethrough a vent passage communicating with said opening formed in said electrode member body;
      said electrode member pivotally affixed to said vent conduit so as to allow said electrode member to pivot in a first, corona generation position, wherein said vent passage formed through said electrode surface interfaces with said slot formed through said outer wall of said vent conduit, or a second, non-corona generation position,
      wherein said vent passage formed through said electrode surface is blocked from interfacing with said slot formed through said outer wall of said vent conduit;
   b. pivoting said electrode member into said first, corona generation position, so as to generate a corona field and initiate exhaust of pollutants from said corona field through the vent passage formed in said electrode surface;
   c. pivoting said electrode member into a second, non-corona generation position, so as to cease generation of said corona field and discontinue exhaust of pollutants from said corona field through the vent passage formed in said electrode surface.

The Push-Pull Segment Design

Figure 5A:
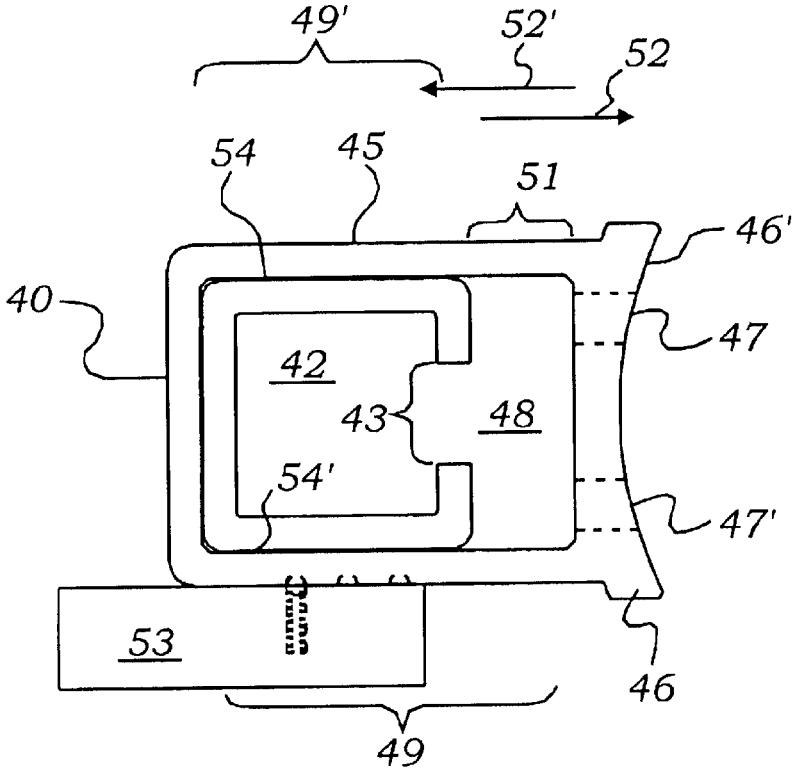
FIGS. 5A and 5B illustrate end and front views of an alternative embodiment of the invention, wherein the electrode array is linearly disassociated from the corona treatment area/treatment roller, as opposed to pivotally disassociated, as in the invention of FIG. 3.
Figure 5B:
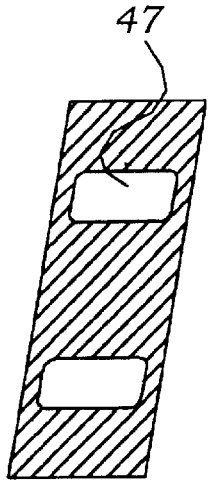

FIG. 5 shows an electrode segment design comprising an alternative embodiment 40 of the present invention that can be fabricated out of a block of aluminum or stainless steel using conventional machining techniques. As shown, the alternative embodiment of the present invention comprises an outer, rectilinearly configured element component 45 forming an elongated rectilinear passage 48 having a width 49 formed therethrough, with one side having emanating therefrom a concave electrode 46 surface having a radial edge 46' analogous to engage the radial outer surface of the treater roller with which if functions, so as to form an evenly spaced treatment area therebetween.

Figure 6:
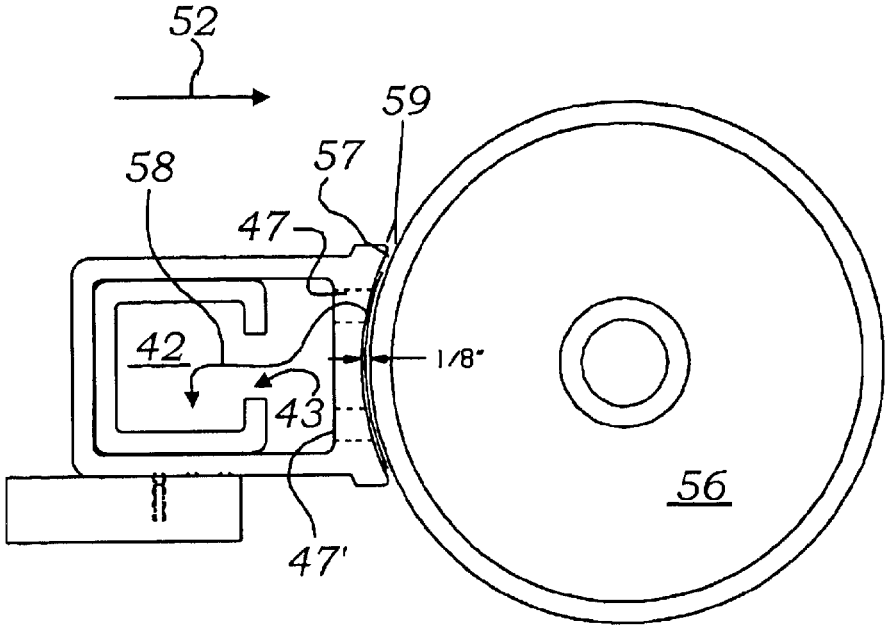
FIGS. 6 and 7 are end views of the invention of FIGS. 5A and 5B, illustrating the electrode array in a treatment and linearly removed position, respectively.

As shown, the electrode 46 surface has formed therethrough first 47, and second 47' exhaust intake passages leading to the interior passage 48 of the element component 45. Situated within a portion of the rectilinearly configured element component 45 is a C-channel vent tube 41 having a longitudinal passage 42 therethrough, as well as first 44, and second 44' lateral members to form a "C" configuration, forming a slot or vent passage 43 therebetween, the C-channel vent tube 41 configured to slidingly engage and support the element component 45, such that the outer upper 54 and lower 54' surfaces slidingly engage the upper 55, and lower 55' interior walls of interior passage 48, with the width 49' of the C channel vent tube less than the width 49 of the interior passage 48 of the element component 45, to form a space 48, so as to allow said element component 45 to be slidingly offset in a fashion lateral to the longitudinal axis of the c-channel vent tube 41, thereby allowing the concave electrode 46 surface to be slidingly positioned in a forward position 52, or in a removed position 52'. Like the preferred embodiment, the C-channel vent tube is supported via ends which extend beyond the rectilinearly configured element component 45 to engage and support via support brackets a mounting base 53, situated in close proximity 59 to the treater roll, such that the rectilinearly configured element component 45 may be slidingly positioned forward relative to the C-channel vent (as shown in FIG. 6) to facilitate the concave electrode 46 surface to be sufficiently close to the treater roll 56 to form a treatment area comprising a corona field 57, with exhaust 58 being drawn through passage 43, into passage 42 to the exhaust processing equipment.

Figure 7:
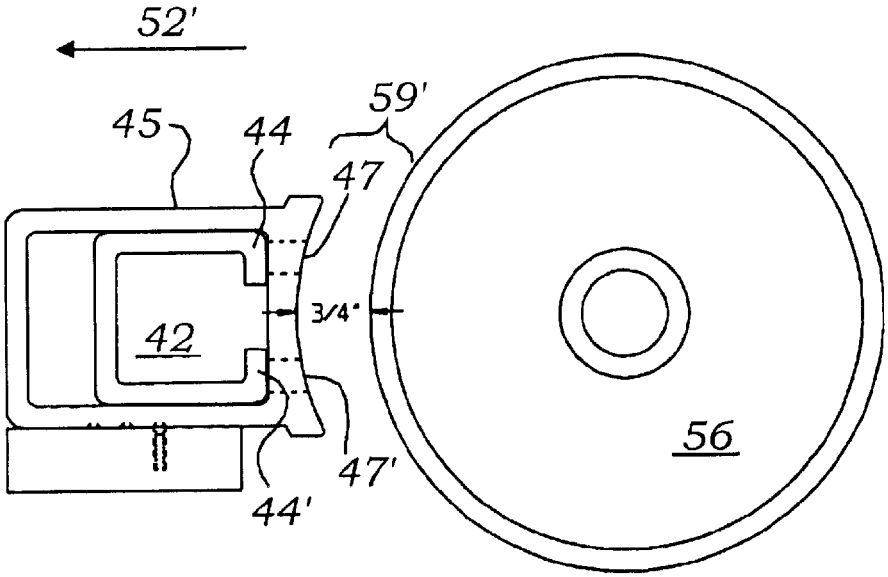

Referring to FIG. 7, sliding back the rectilinear element component 45 causes first and second lateral members 44, 44' to block first 47 and second 47' exhaust intake passages, respectively, closing off the exhaust flow to passage 42, while separating 59' the concave electrode 46 surface sufficiently from the treater roller 56 to cease interaction between the electrode and the treater roll, ceasing the corona field.

The disadvantage of the pivotal segment as compared with the push-pull segment is that the pivotal segment requires a much larger travel envelope due to its moving in an arc. On the other hand, the disadvantage of the push-pull segment is that it requires a much more intricate locking mechanism to retain it in the treat or no treat positions.

In the treat position, the segment 'makes' corona in the narrow air gap while simultaneously forms an exhaust passage through which ozone can be removed. In the no-treat position, the substantially larger air gap breaks the flow of electricity and no corona is generated. The novelty in the design of the push-pull segment is that the exhaust passage is blocked using a linear motion rather than a pivotal motion.

The mechanism to retain the push-pull segment in its treat and no-treat positions involves additional components as compared with the pivotal segment, which requires none. The requirement for either design is the same in that the segment must stay in a permanent position, whether it is for treat or no treat. A possible mechanism to retain the push-pull segment in its position is to use a conventional ball plunger as shown in FIGS. 6 and 7. Three round dimples are cut in the bottom of the segment to provide three positions: treat, end seal, and no treat. The 'end seal' position, an intermediate position between treat and no-treat, may be necessary to seal the side opening in the last treat segment on each end of a treat lane.

Figure 8:
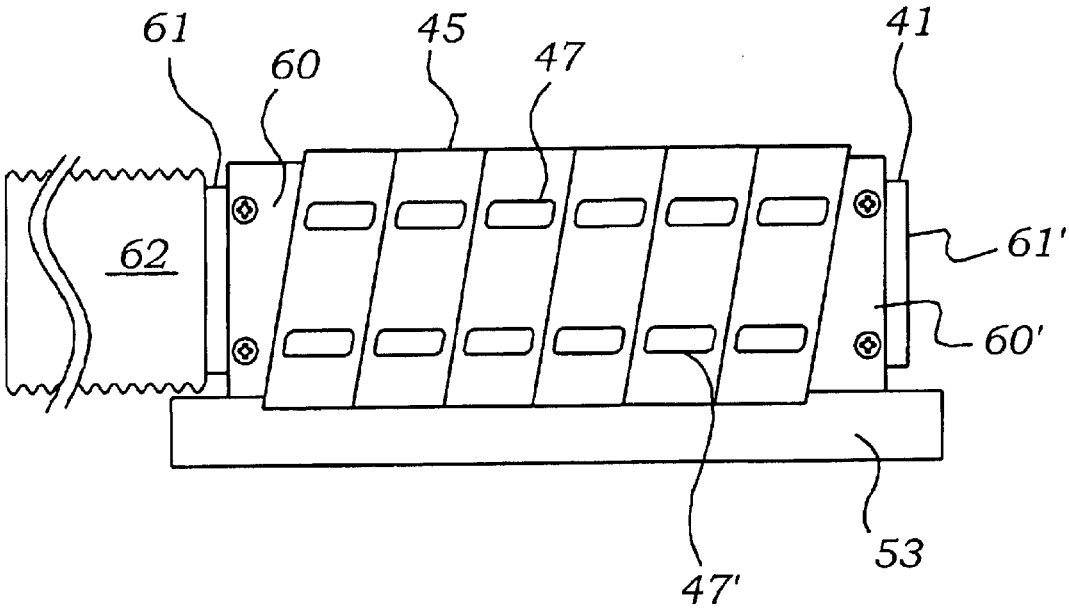
FIG. 8 is a frontal view of the invention of FIGS. 5A and 5B, illustrating multiple electrodes forming the electrode array.

FIG. 8 shows the front view of a simplified assembly of the Ozone Removable Corona Electrode System with multiple push-pull segments. Standard engineering principles and calculations can be applied to optimize the fit, form and function. These include determining the size of the ozone exhaust slot, the shape of the inlet, airflow calculations, motor sizing and tolerance dimensioning.

As shown, a plurality of element components 45 are engaged in face to face, side-stacked fashion to form a single, element having exhaust intake passages 47, 47'. As earlier indicated, C-channel vent tube 41 has first and second ends 61, 61' which are supported via first 60 and second 60' brackets, respectively, which in turn engage and are supported via base 53.

An exhaust 62 component communicates with the passage 42 formed in the C-channel vent tube to provide low pressure suction to facilitate exhaust into exhaust ports 47, 47' from the corona treatment field when in operation.

In summary, the method of the alternative embodiment of the present invention can comprise, for example:

The method of providing a corona field in the vicinity of an outer surface of a treater roll having an outer surface, comprising the steps of:

a. providing a corona electrode system, comprising:
   a vent conduit having first and second ends, an outer wall, a longitudinal axis, and a slot formed through said outer wall;
   an electrode member comprising an electrode member body having an opening formed therethrough to receive said outer wall of said vent conduit, said electrode member further comprising an electrode surface for corona field generation, said electrode surface having formed therethrough a vent passage communicating with said opening formed in said electrode member body;
   said electrode member pivotally affixed to said vent conduit so as to allow said electrode member to pivot in a first, corona generation position, wherein said vent passage formed through said electrode surface interfaces with said slot formed through said outer wall of said vent conduit, or a second, non-corona generation position, wherein said, wherein said vent passage formed through said electrode surface is blocked from interfacing with said slot formed through said outer wall of said vent conduit;
b. pivoting said electrode member into said first, corona generation position, so as to generate a corona field and initiate exhaust of pollutants from said corona field through the vent passage formed in said electrode surface;
c. pivoting said electrode member into a second, non-corona generation position, so as to cease generation of said corona field and discontinue exhaust of pollutants from said corona field through the vent passage formed in said electrode surface.

Ozone Exhaust System

Figure 9:
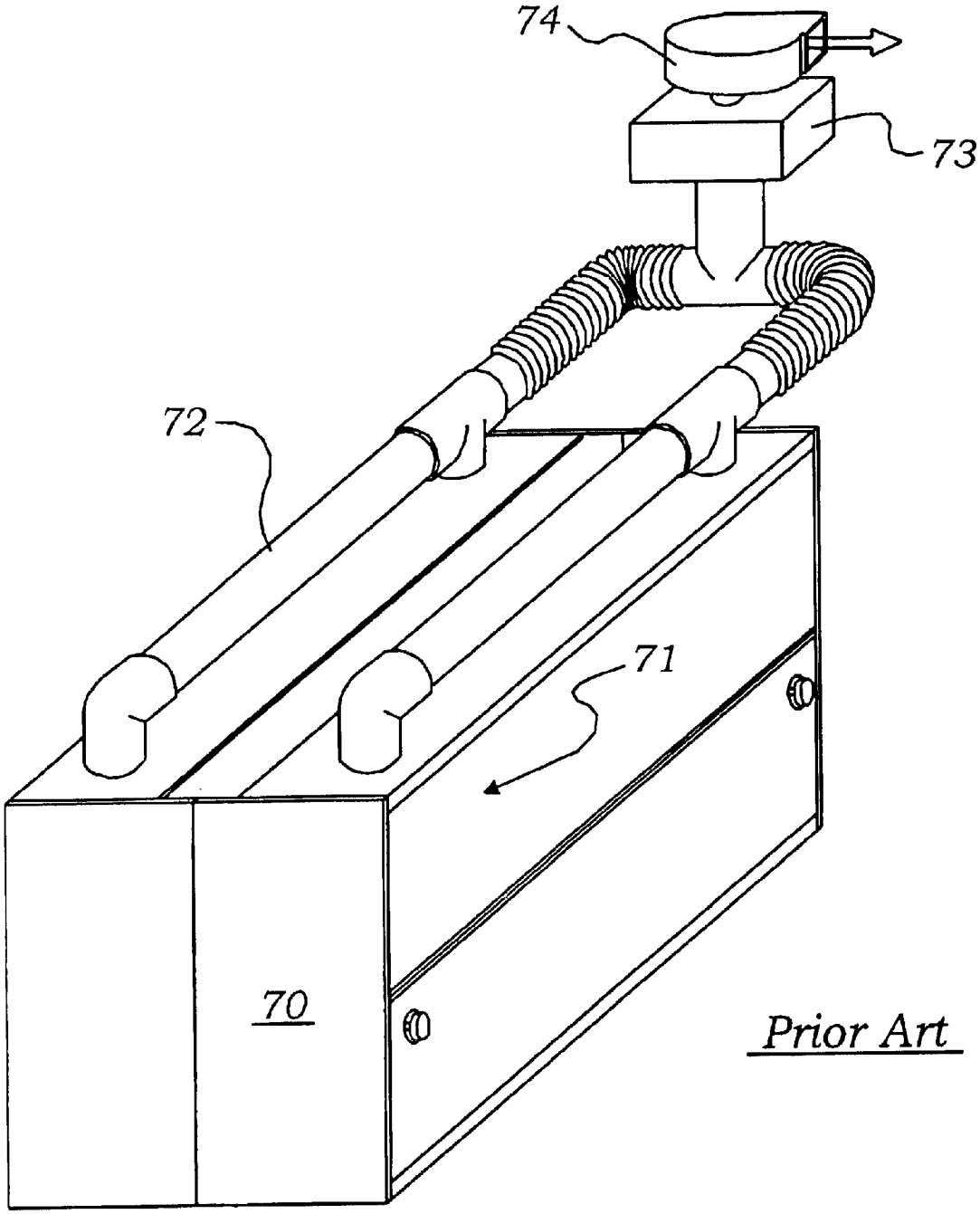
FIG. 9 illustrates an isometric view of a blower/exhaust removal.

An ozone exhaust system includes an exhaust blower, a charcoal filter and the necessary ducting to connect the treater station to the blower. FIG. 9 shows a conventional setup in that the treater station does not employ the Ozone Removable Electrode System. Standard engineering calculation as used in the corona industry is based on the empirical data, which states that the volume of air inside a treater station has to be purged at a rate of twenty (20) times per minute to totally remove the amount of ozone generated. The exhaust requirement can be calculated as below:

| | |
|---|---|
| typical size treater station: | 20" Wd × 35" Ht × 75" lg. |
| volume of such station: | 30 cubic feet |
| flow rate needed: | 20 × 30 cubic feet per minute = 600 $ft^3$ per minute |

One should note that in this standard system, a cabinet 70 is employed about the corona field generator/treater roll, the cabinet having an interior including low pressure exhaust vents 71 which guide exhaust from the corona generation process through vent tubes 72, through charcoal filter 73 or the like, which is driven by blower 74.

The reason for such a high airflow is that ozone dilutes immediately as soon as it is generated at the electrodes and spreads out very quickly inside the treater station. The design and construction for a charcoal filter and piping system have to be robust and very large to allow the exhaust blower to function adequately. At the same time, the system requires regular maintenance to change out the charcoal and the mechanical filters. Heaters are sometimes installed to dry out the exhaust air prior to introducing it to the filter to reduce clogging due to trapped moisture.

The ozone exhaust ducting for a conventional treater station is simply composed of flange mounted outlet pipes that are mounted on the topside or the bottom side of the station.

Figure 10:
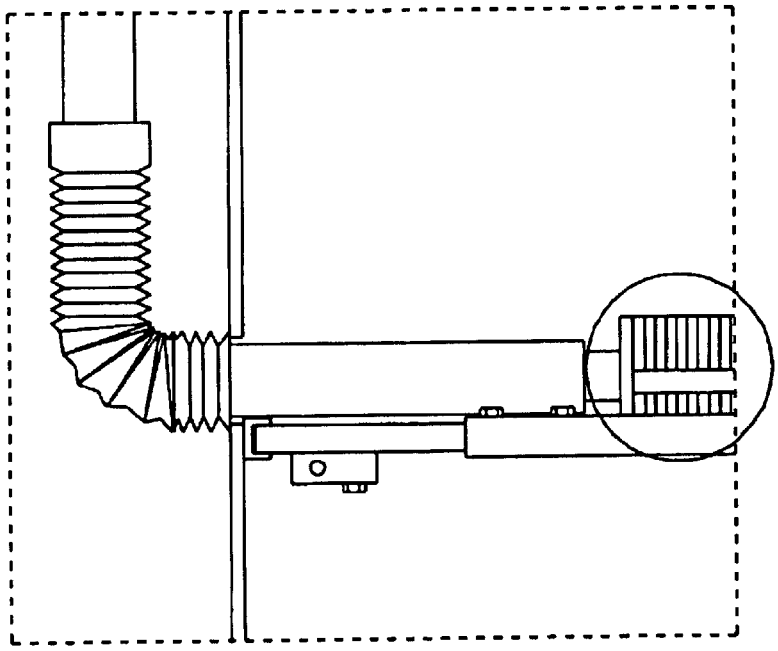
FIG. 10 illustrates a frontal view of a portion of the blower/exhaust removal system as may be utilized in conjunction with the preferred embodiment of the present invention.
Figure 11:
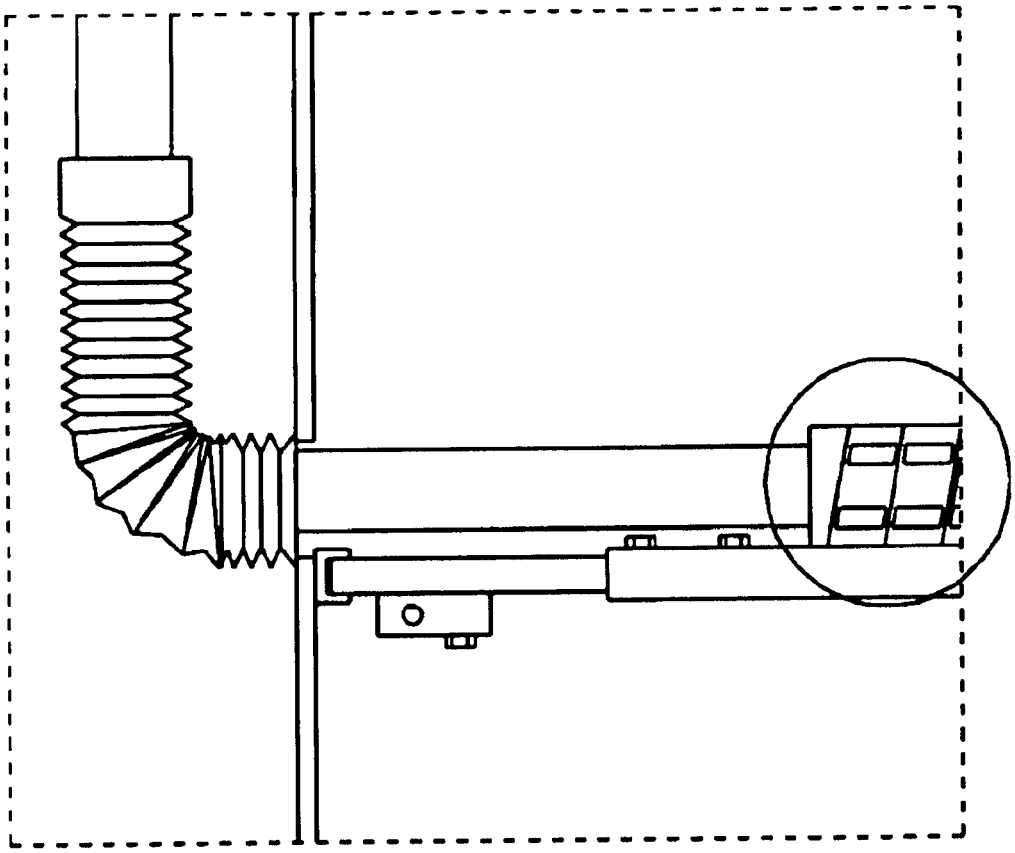
FIG. 11 illustrates a frontal view of a portion of the blower/exhaust removal system as may be utilized in conjunction with the alternative embodiment of the present invention.

In comparison, the Ozone Removable Electrode System of the present invention provides a central ozone exhaust tube—the ends of which comprise the outlet for ozone exhaust connection. FIGS. 10 and 11 show the ozone exhaust connection for a station using the pivotal electrode design (preferred embodiment) and a station using the push-pull electrode (alternative embodiment) design, respectively.

The concentration of ozone in the air immediately surrounding the electrodes is the highest, estimated at 200 ppm. By allowing the ozone laden air to be removed at the source, the effectiveness is obvious. Moreover, other efficiency and additional benefits are easily gained including substantially lower CFM (cubic feet per minute), lighter ducting, low maintenance required for the filters due to dryer (heated by the corona) exhaust air, and a much smaller exhaust motor.

Figure 12:
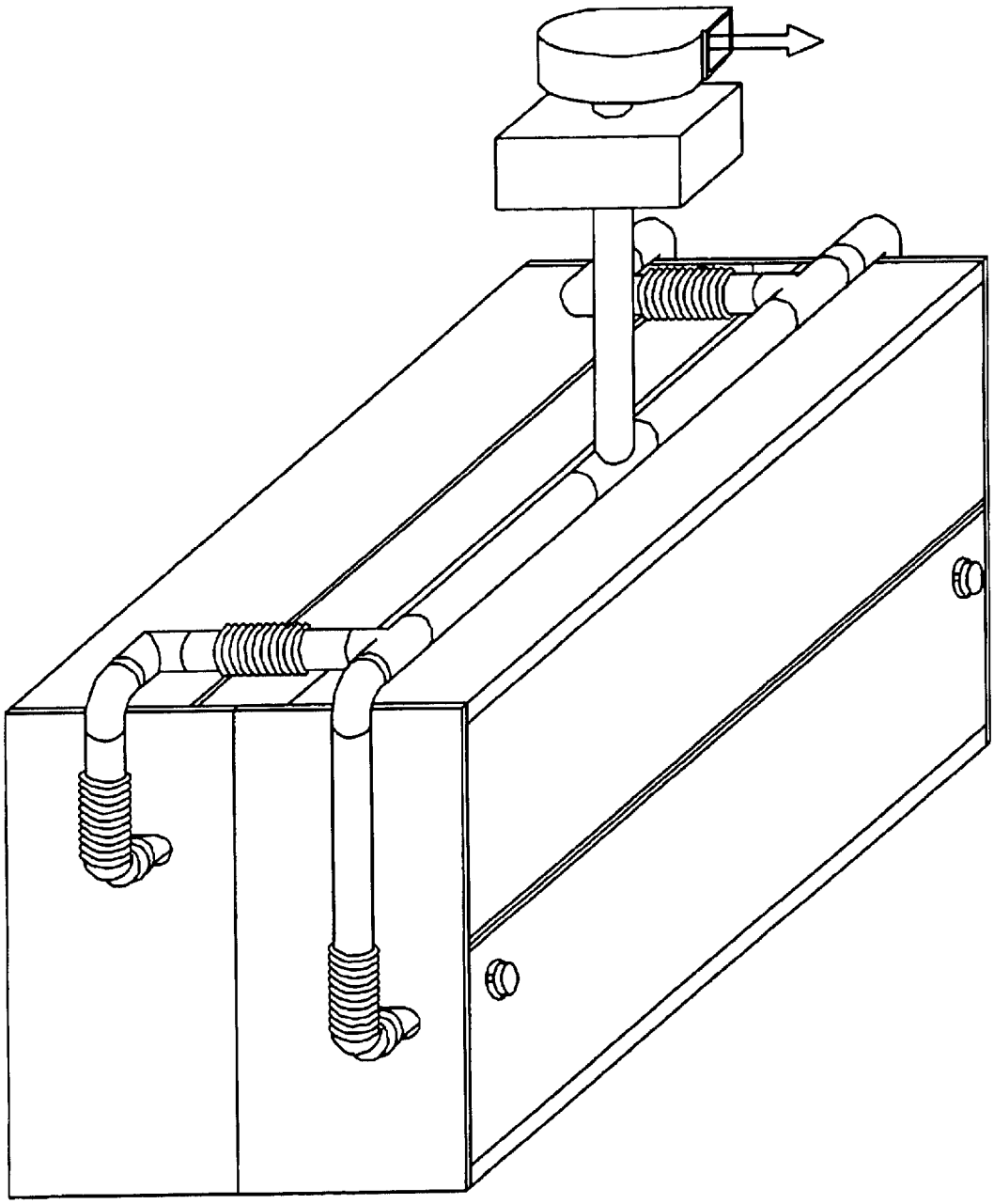
FIG. 12 illustrates an isometric view of a blower/exhaust removal system for utilization in conjunction with the alternative embodiment of the present invention.

FIG. 12 shows a possible setup for an ozone destruct system, which can be used for a station utilizing the Ozone Removable Electrode System.

For dielectric covered electrodes, mainly with ceramic-based materials, the built-in ozone exhaust inlet means that the electrodes are further cooled with forced air. These electrodes are prone to cracking due to high operating temperatures of over 250° F. without forced air cooling. As fresh air is drawn into the face of the electrodes to remove ozone, their operating temperatures can greatly be reduced.

The intense heat from the corona is capable of elevating the temperature of the exhaust air by 40° F. or more over ambient and greatly helps in reducing its moisture content. The preheated and dryer air minimizes clogging the mechanical filters and damaging the charcoal filters. This will extend the life and reduce the maintenance of the ozone destruct system.

By eliminating a separate component, which is required to remove ozone, the physical size of the treater station can be made substantially more compact. Moreover, exposure to ozone by the internal mechanism and components inside the treater station is minimized. Since ozone causes oxidation and rust, less exposure means that the operation of the station and its periodic maintenance are less troublesome.

Air Gap Adjustment

Figure 13:
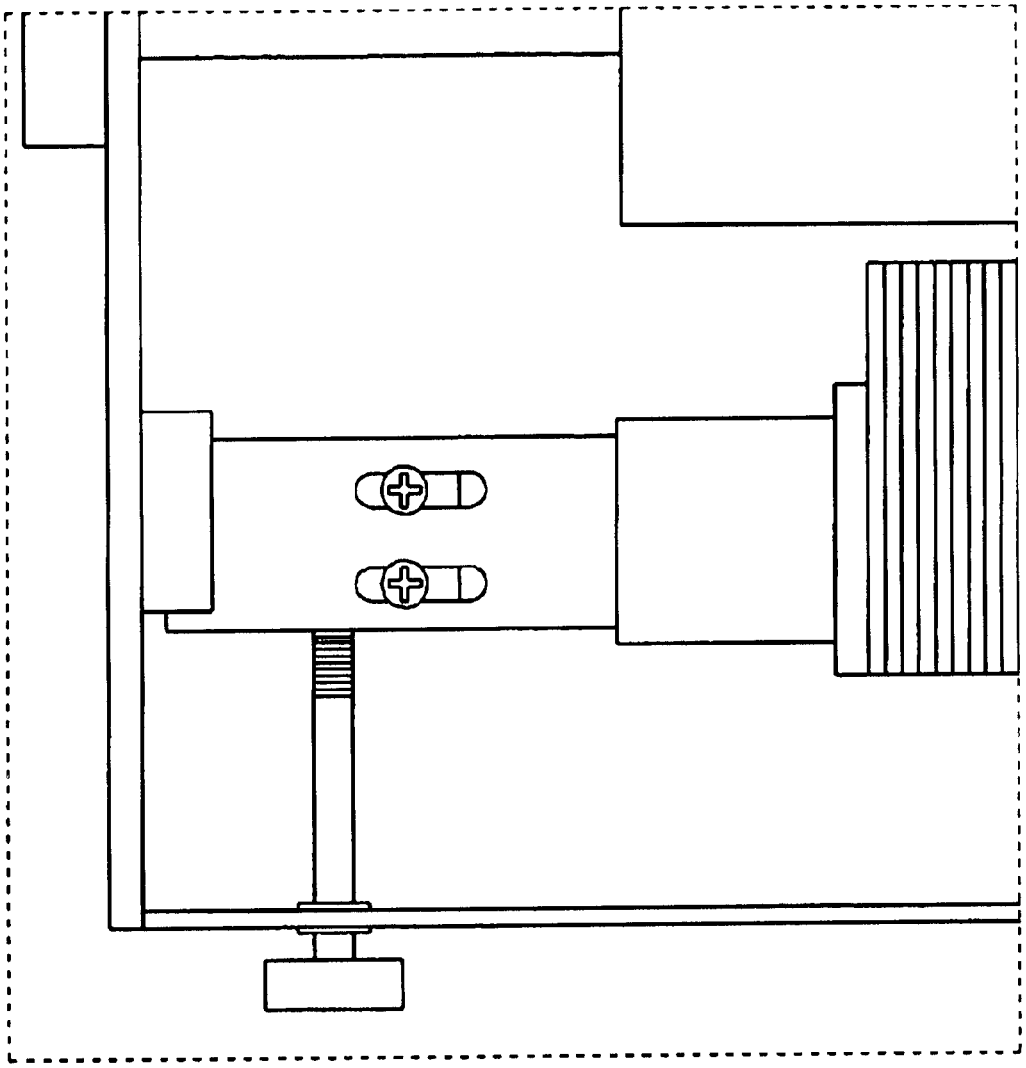
FIG. 13 illustrates a top view of a portion of the exhaust/blower system of the present invention associated with modifying the air gap of same.

The same mechanism typically employed to adjust the air gap can be used for the Ozone Removable Electrode System, as can be seen in FIG. 13. The novelty is that an existing treater station design only requires minimal modification to adapt as follows. A tube made of a suitable insulator material is attached to the end(s) of the ozone exhaust tube to provide electrical isolation.

The insulated tube is inserted through an elongated hole, which is machined in the side panel of the treater station to allow for movement as the air gap is adjusted. Some mechanical means is provided to allow the insulated tube to be permanently attached to and supported by the insulator bar. This completes the modification.

The invention embodiments herein described are done so in detail for exemplary purposes only, and may be subject to many different variations in design, structure, application and operation methodology. Thus, the detailed disclosures therein should be interpreted in an illustrative, exemplary manner, and not in a limited sense.

I claim:

1. A corona electrode system, comprising:

a vent conduit having first and second ends, an outer wall, a longitudinal axis, and a slot formed through said outer wall;

an electrode component comprising an electrode body having an opening formed therethrough to receive said outer wall of said vent conduit, said electrode component further comprising an electrode surface for corona field generation, said electrode surface having formed therethrough a vent passage communicating with said opening formed in said electrode body;

said electrode component pivotally affixed to said vent conduit so as to allow said electrode member to pivot in a first, corona generation position, wherein said vent passage formed through said electrode surface interfaces with said slot formed through said outer wall of said vent conduit, or a second, non-corona generation position, wherein said vent passage formed through said electrode surface is blocked from interfacing with said slot formed through said outer wall of said vent conduit.

2. The corona electrode system of claim 1, wherein there is further provided ozone collection and filtering means associated with said vent conduit.

3. The corona electrode system of claim 2, wherein said ozone collection and filtering means comprises an exhaust fan and a charcoal filter.

4. The corona electrode system of claim 3, wherein there is further provided a treater roller having an outer radial surface, and wherein said electrode surface of said electrode member has a concave radial surface formed to provide a uniform treatment area between said treater roller and said electrode surface of said electrode component.

5. The corona electrode system of claim 4, wherein said electrode component comprises a plurality of electrode members situated in face-to-face engagement.

6. The method of providing a corona field in the vicinity of an outer surface of a treater roll having an outer surface, comprising the steps of:

a. providing a corona electrode system, comprising:

a vent conduit having first and second ends, an outer wall, a longitudinal axis, and a slot formed through said outer wall;

an electrode member comprising an electrode member body having an opening formed therethrough to receive said outer wall of said vent conduit, said electrode member further comprising an electrode surface for corona field generation, said electrode surface having formed therethrough a vent passage communicating with said opening formed in said electrode member body;

said electrode member pivotally affixed to said vent conduit so as to allow said electrode member to pivot in a first, corona generation position, wherein said vent passage formed through said electrode surface interfaces with said slot formed through said outer wall of said vent conduit, or a second, non-corona generation position, wherein said, wherein said vent passage formed through said electrode surface is blocked from interfacing with said slot formed through said outer wall of said vent conduit;

b. pivoting said electrode member into said first, corona generation position, so as to generate a corona field and initiate exhaust of pollutants from said corona field through the vent passage formed in said electrode surface;

c. pivoting said electrode member into a second, non-corona generation position, so as to cease generation of said corona field and discontinue exhaust of pollutants from said corona field through the vent passage formed in said electrode surface.

7. A corona electrode system, comprising:

a rectilinear, "C" configured vent conduit having first and second ends, an upper and lower wall having first and second edges, a first sidewall engaging said first edges of said upper and lower walls, and first and second lateral edges emanating from said second edge of said upper and lower walls so as to form an open channel therebetween;

a generally rectilinear electrode component comprising an electrode body having a rectilinear opening formed therethrough to receive said upper, lower, and side walls of said "C" configured vent conduit, said electrode member further comprising an electrode surface for corona field generation, said electrode surface having formed therethrough a vent passage communicating with said opening formed in said electrode member body;

said electrode member slidingly affixed to said vent conduit so as to allow said electrode member to slide in a first, corona generation position, wherein said vent passage formed through said electrode surface interfaces with the open channel formed between said first and second sidewalls formed in said "C" configured vent conduit, or a second, non-corona generation position, wherein said, wherein said vent passage formed through said electrode surface is blocked by one of said first or second sidewalls formed in said "C" configured vent conduit.

8. The corona electrode system of claim 1, wherein there is further provided ozone collection and filtering means associated with said vent conduit.

9. The corona electrode system of claim 2, wherein said ozone collection and filtering means comprises an exhaust fan and a charcoal filter.

10. The corona electrode system of claim 1, wherein there is further provided a treater roller having an outer radial surface, and wherein said electrode surface of said electrode member has a concave radial surface formed to provide a uniform treatment area between said treater roller and said electrode surface of said electrode member.

11. The method of providing a corona field in the vicinity of an outer surface of a treater roll having an outer surface, comprising the steps of:

a. providing a corona electrode system, comprising:

a rectilinear, "C" configured vent conduit having first and second ends, an upper and lower wall having first and second edges, a first sidewall engaging said first edges of said upper and lower walls, and first and second lateral edges emanating from said second edge of said upper and lower walls so as to form an open channel therebetween;

a generally rectilinear electrode component comprising an electrode body having a rectilinear opening formed therethrough to receive said upper, lower, and side walls of said "C" configured vent conduit, said electrode member further comprising an electrode surface for corona field generation, said electrode surface having formed therethrough a vent passage communicating with said opening formed in said electrode member body;

said electrode member slidingly affixed to said vent conduit so as to allow said electrode member to slide in a first, corona generation position, wherein said vent passage formed through said electrode surface interfaces with the open channel formed between said first and second sidewalls formed in said "C" configured vent conduit, or a second, non-corona generation position, wherein said, wherein said vent passage formed through said electrode surface is blocked by one of said first or second sidewalls formed in said "C" configured vent conduit;

b. sliding said electrode member into said first, corona generation position, so as to generate a corona field and initiate exhaust of pollutants from said corona field through the vent passage formed in said electrode surface;

c. sliding said electrode member into a second, non-corona generation position, so as to cease generation of said corona field and discontinue exhaust of pollutants from said corona field through the vent passage formed in said electrode surface.

* * * * *